US009167942B1

(12) United States Patent
Seasholtz et al.

(10) Patent No.: US 9,167,942 B1
(45) Date of Patent: Oct. 27, 2015

(54) VACUUM CLEANER WITH HOSE FENCE AND TOOL STORAGE

(71) Applicant: SHOP VAC CORPORATION, Williamsport, PA (US)

(72) Inventors: Craig A. Seasholtz, Avis, PA (US); Robert Lent Crevling, Jr., Cogan Station, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 0 days.

(21) Appl. No.: 14/445,884

(22) Filed: Jul. 29, 2014

(51) Int. Cl.
*A47L 9/00* (2006.01)
*A47L 5/36* (2006.01)

(52) U.S. Cl.
CPC ..... *A47L 9/0027* (2013.01); *A47L 5/365* (2013.01); *A47L 9/0036* (2013.01); *A47L 9/0045* (2013.01)

(58) Field of Classification Search
CPC ... A47L 9/0018; A47L 9/0027; A47L 9/0036; A47L 9/0045; A47L 9/0009; A47L 9/14; A47L 5/365
See application file for complete search history.

(56) References Cited

U.S. PATENT DOCUMENTS

| | | | | |
|---|---|---|---|---|
| 2,450,172 | A * | 9/1948 | Stoner | 15/323 |
| 2,713,696 | A * | 7/1955 | Gorham | 15/246.2 |
| 2,935,760 | A * | 5/1960 | Martinec | 15/323 |
| 3,869,265 | A * | 3/1975 | Wolter et al. | 15/327.2 |
| 4,563,789 | A * | 1/1986 | Berfield | 15/323 |
| 6,175,988 | B1 * | 1/2001 | White et al. | 15/327.1 |
| 6,502,276 | B2 * | 1/2003 | Iversen | 15/323 |
| 6,588,052 | B2 * | 7/2003 | Iversen | 15/323 |
| 6,813,806 | B2 * | 11/2004 | Martinez | 15/323 |
| 2015/0013100 | A1 * | 1/2015 | Gottschall et al. | 15/323 |

* cited by examiner

*Primary Examiner* — Dung Van Nguyen
(74) *Attorney, Agent, or Firm* — Marshall, Gerstein & Borun LLP

(57) ABSTRACT

A new vacuum cleaner has a removable rack that combines both tool storage elements and hose fence elements in a compact arrangement. The rack is snapped in place. Laterally-spaced fence elements help hold the hose against the main body of the vacuum cleaner, and hooked upper ends help to retain the hose in place. The outer surfaces of the fence element have adjacent concave outer surfaces that form parts of two separate tool storage elements. One of the retainers has opposed ends that form a clip that can hold a vacuum hose accessory in place. The other retainer has a lower lateral end that extends radially outwardly to an upwardly projecting stem section. The stem section is sized to fit within an interior portion of a vacuum hose accessory.

10 Claims, 10 Drawing Sheets

VACUUM CLEANER WITH HOSE FENCE AND TOOL STORAGE

CROSS-REFERENCE TO RELATED APPLICATIONS

Not applicable.

BACKGROUND OF THE INVENTION

The present invention relates generally to vacuum cleaners, and more particularly to household vacuum cleaners that have a tank, a lid, and a hose.

Household vacuum cleaners commonly have long hoses and accessories that attach to the hose, such as shaped nozzles. Not all purchasers keep the original carton packaging, and when the vacuum cleaner is stored in a closet, the hose and accessories tend to end up sprawled across the closet.

Some vacuum cleaners have been provided with tool storage holes or slots, like those shown in D623367 and in D676207, that can be used for storing accessories.

Others vacuum cleaners have been provided with hose fence elements like the one seen in co-pending application Ser. No. 29/458,837.

BRIEF SUMMARY

The applicants have developed a new vacuum cleaner that has a removable rack that combines both tool storage elements and hose fence elements in a compact arrangement.

Like previously known vacuum cleaners, the new vacuum cleaner has a tank, a hose, and a lid that mounts to a rim on the tank. Unlike previously known vacuum cleaners, the new vacuum cleaner has a rack that not only has hose fence elements that are arranged to help hold the hose against the main body of the vacuum cleaner in a stored arrangement, but also has tool storage elements that hold accessories. The fence elements and the tool storage elements are specially arranged to maintain a compact profile.

The rack may have wall segments that that fit against outer surfaces of a peripheral wall on the main body of the vacuum cleaner. A laterally disposed deflectable attachment snap on the rack fits into a recess on the lid when the rack is mounted, inhibiting the frame section from being lifted from the main body of the vacuum cleaner.

The rack has laterally-spaced fence elements that are arranged to help to hold the hose against the main body of the vacuum cleaner in a stored arrangement. Each of the fence elements may have a base that is spaced outwardly away from a corresponding element of the main body, an intermediate section that rises generally vertically from the base section, and an inwardly hooked upper end. The fence elements are positioned so that the hose can be positioned laterally between the intermediate section and the main body of the vacuum cleaner, and the hooked upper end helps to retain the hose between the main body and the intermediate section when the hose is stored there.

The outer surface of the intermediate section of each hose fence element may have a pair of laterally adjacent concave outer surfaces that form parts of two separate tool storage elements. Hose accessory retainers are provided at the lower ends of the surfaces. One of the retainers has opposed ends that form a clip that can hold a vacuum hose accessory in place. The other retainer has a lower lateral end that extends radially outwardly to an upwardly projecting stem section. The stem section is sized to fit within an interior portion of a vacuum hose accessory and inhibit that vacuum hose accessory from moving outwardly when the accessory is mounted there.

BRIEF DESCRIPTION OF THE DRAWINGS

The invention may be better understood by referring to the accompanying drawings, in which.

DETAILED DESCRIPTION

Figure 1:
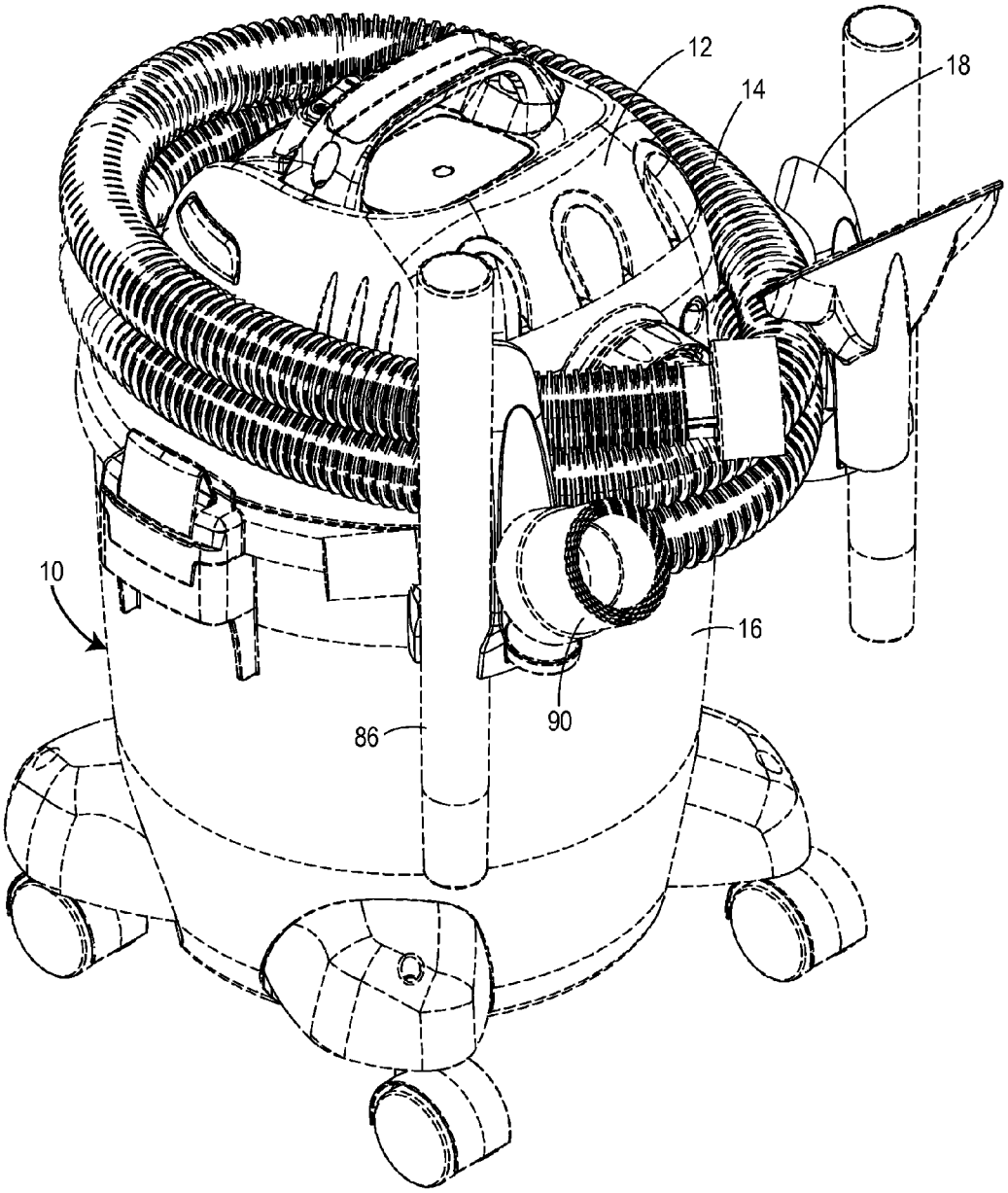
FIG. 1 is an isometric view of a vacuum cleaner that forms one embodiment of the invention.
Figure 2:
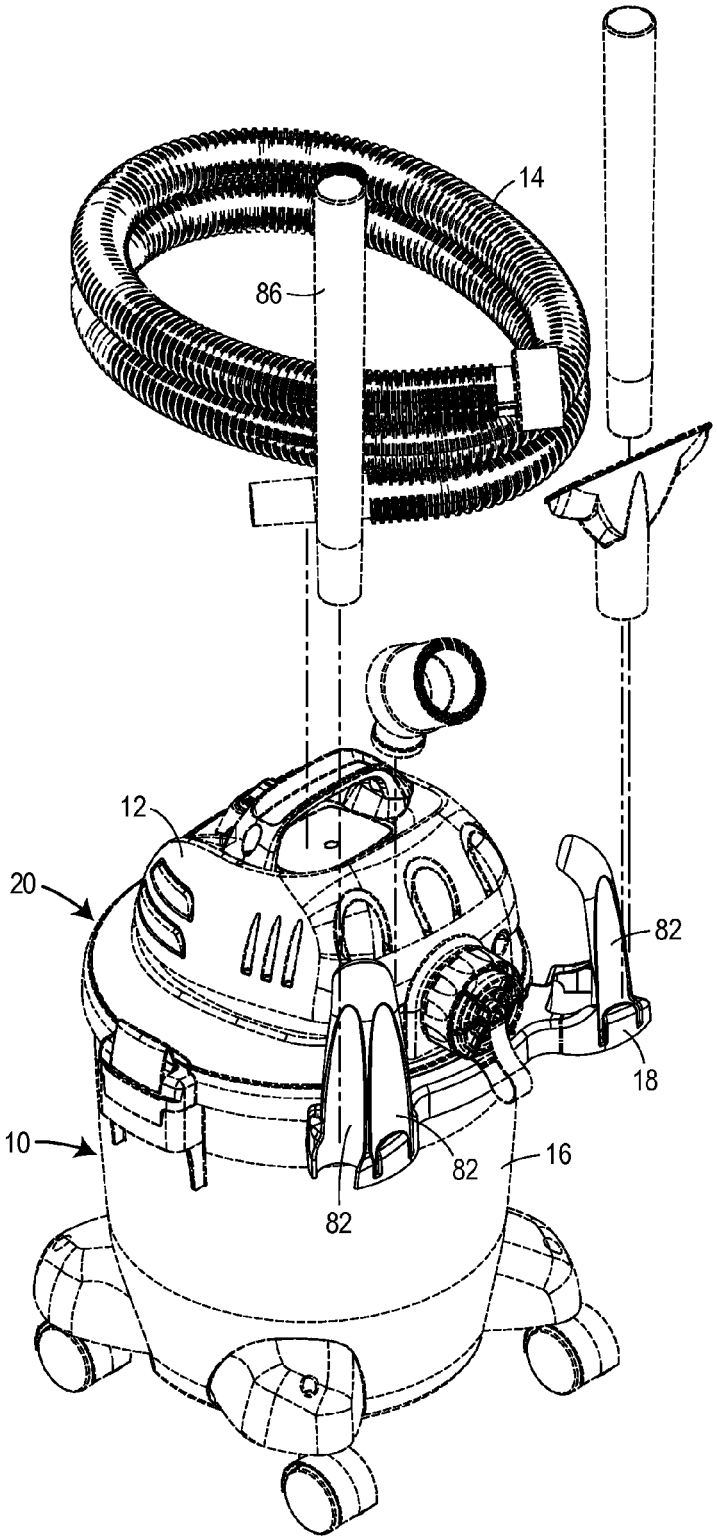
FIG. 2 is an exploded isometric view.
Figure 3:
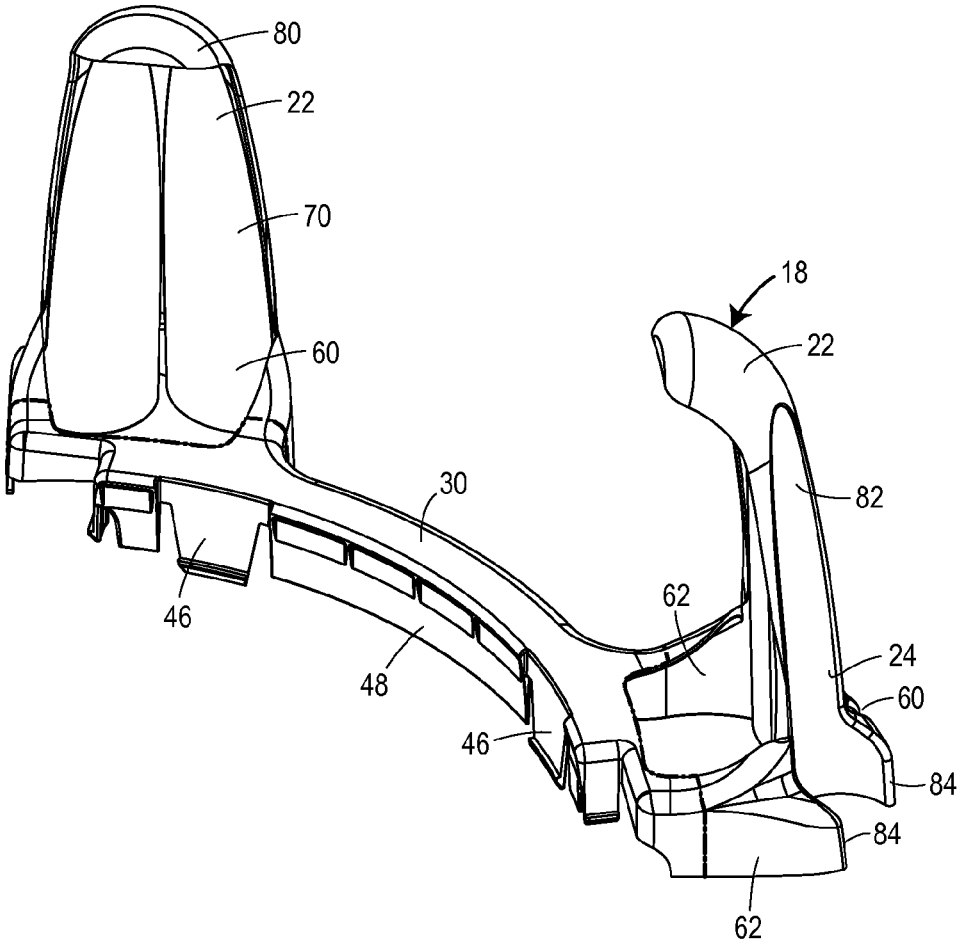
FIGS. 3 and 4 are isometric views of the rack of the vacuum cleaner.

As seen in FIGS. 1 and 2, the new vacuum cleaner 10 has a lid 12, a hose 14, a tank 16, and a rack 18.

The Lid, Hose, and Tank

As seen in FIGS. 1 and 2, the lid 12 mounts atop the tank 16, forming the main body 20 of the vacuum cleaner. The illustrated lid is made of molded plastic, and a wide range of known alternative configurations can be used. The lid houses an internal vacuum source, such as an air impeller (not seen) that draws debris (or, in some cases, liquid) through the hose 14. Typically, such vacuum sources operate in the range of 0.5 peak horsepower to 6.5 peak horsepower. However, a rating from 0.2 peak horsepower to 12 peak horsepower may not be extraordinary.

The illustrated vacuum hose 14 is made of plastic, is generally between 1 and 6 inches in diameter, and between 1 and 20 feet in length. A wide range of options are known and can be used.

Through conventional ducting (not illustrated) on the lid 12, material drawn in through the hose 14 is deposited in the tank 16. The illustrated tank is made of molded plastic, but metal tanks are also possible. Typically, tanks that are arranged in the same manner as the illustrated tank have a nominal capacity of 1½ to 20 gallons. A capacity from 1 gallon to 65 gallons may be feasible.

The Rack

The rack 18, seen in FIGS. 2-10, forms both the fence elements 22 and the tool storage elements 24. The illustrated rack is made of molded plastic, though other materials could also be used. The illustrated rack is believed to have a pleasing ornamental configuration that is the subject of a co-pending design application and not critical to the functionality of the invention.

Figure 11:
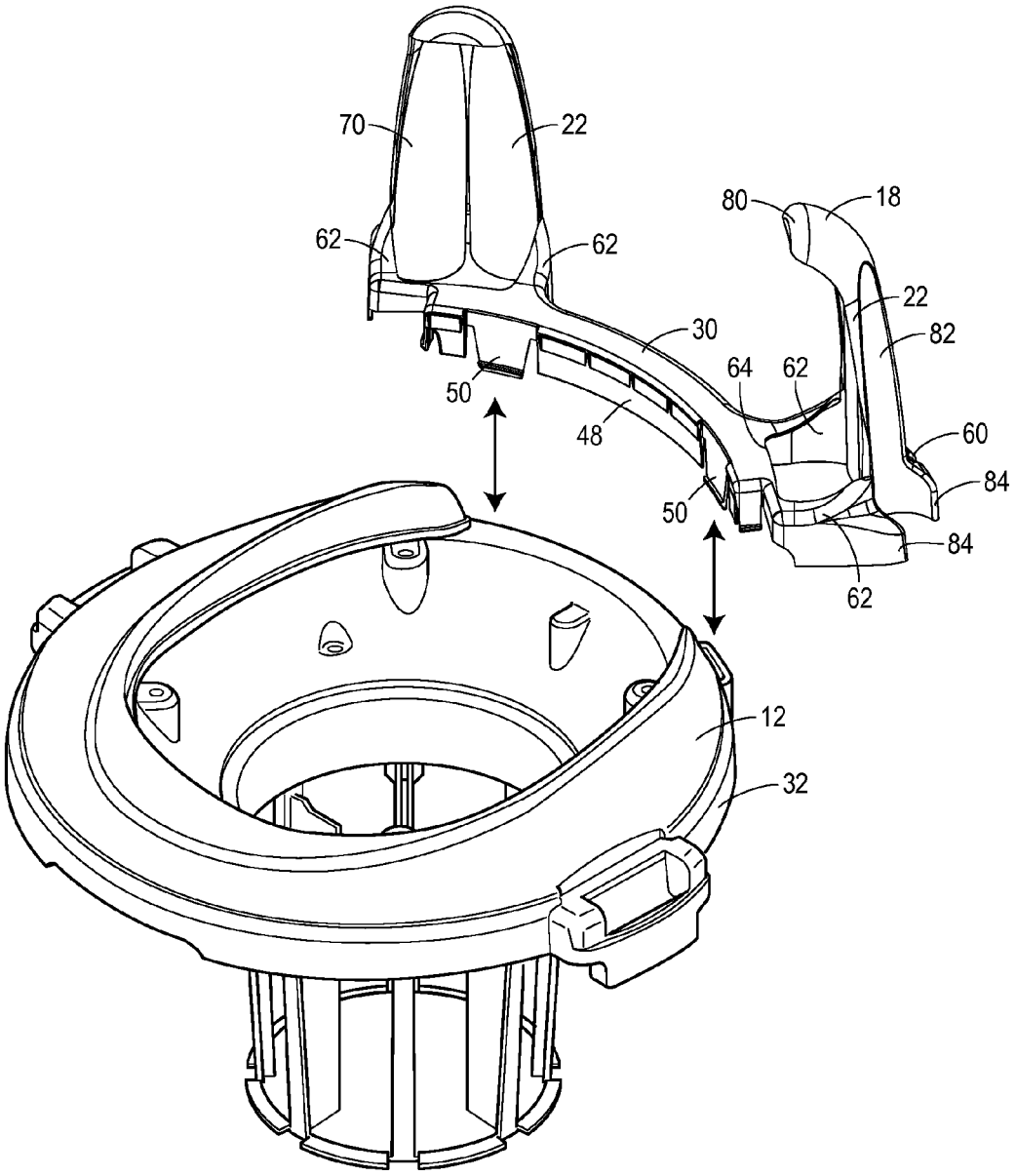
FIGS. 11 and 12 are exploded isometric views of a portion of the lid and the rack.

As seen in FIG. 11, the illustrated rack 18 has a frame section 30 that fits onto on outer rim 32 on the lid 12 of the tank 16. In other arrangements, the rack might alternatively fit onto a rim on the tank 16. The illustrated frame section spans at least 20 degrees of the circumference of the lid, and preferably at least 45 degrees of the main body 20. Outer wall segments descend from the frame section and fit against the outer side of the outer rim, helping to position the rack on the main body of the vacuum cleaner. The illustrated rack has two outer wall segments 46 that flank a central wall segment 48, though other arrangements could be used. The illustrated wall segments are between ¼ inches and three inches in height, and could be of virtually any width.

Figure 12:
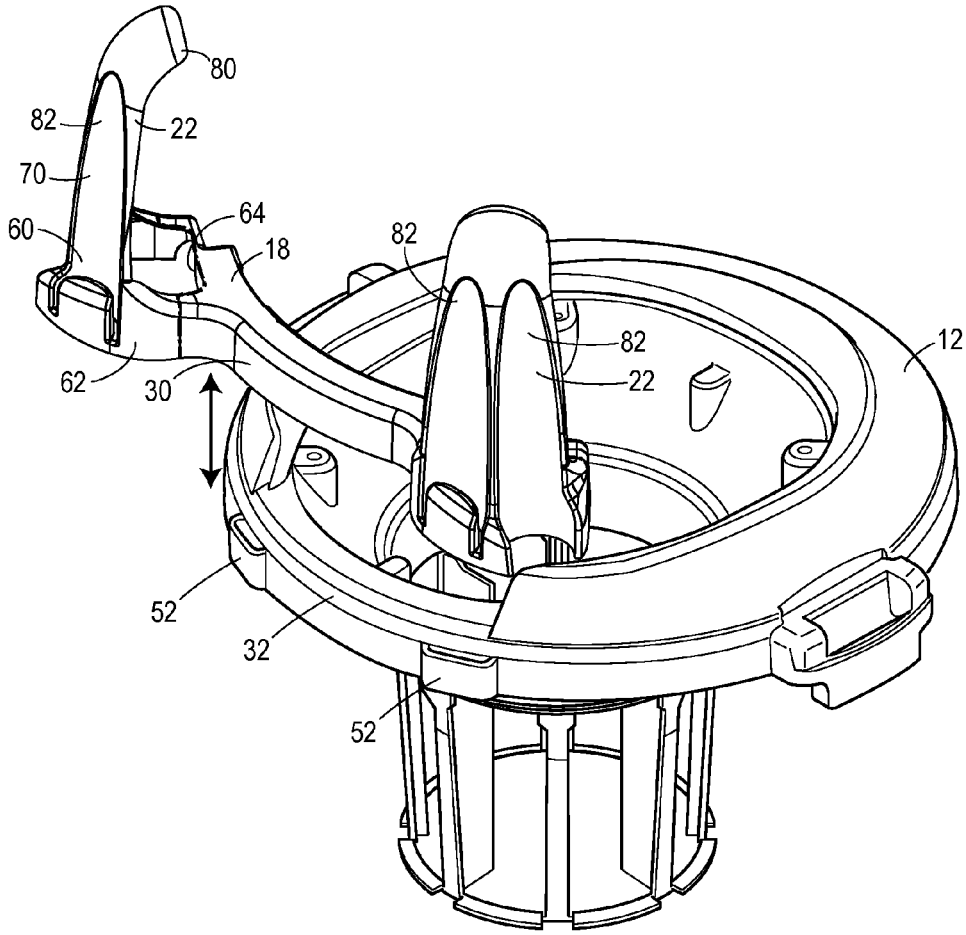
Figure 13:
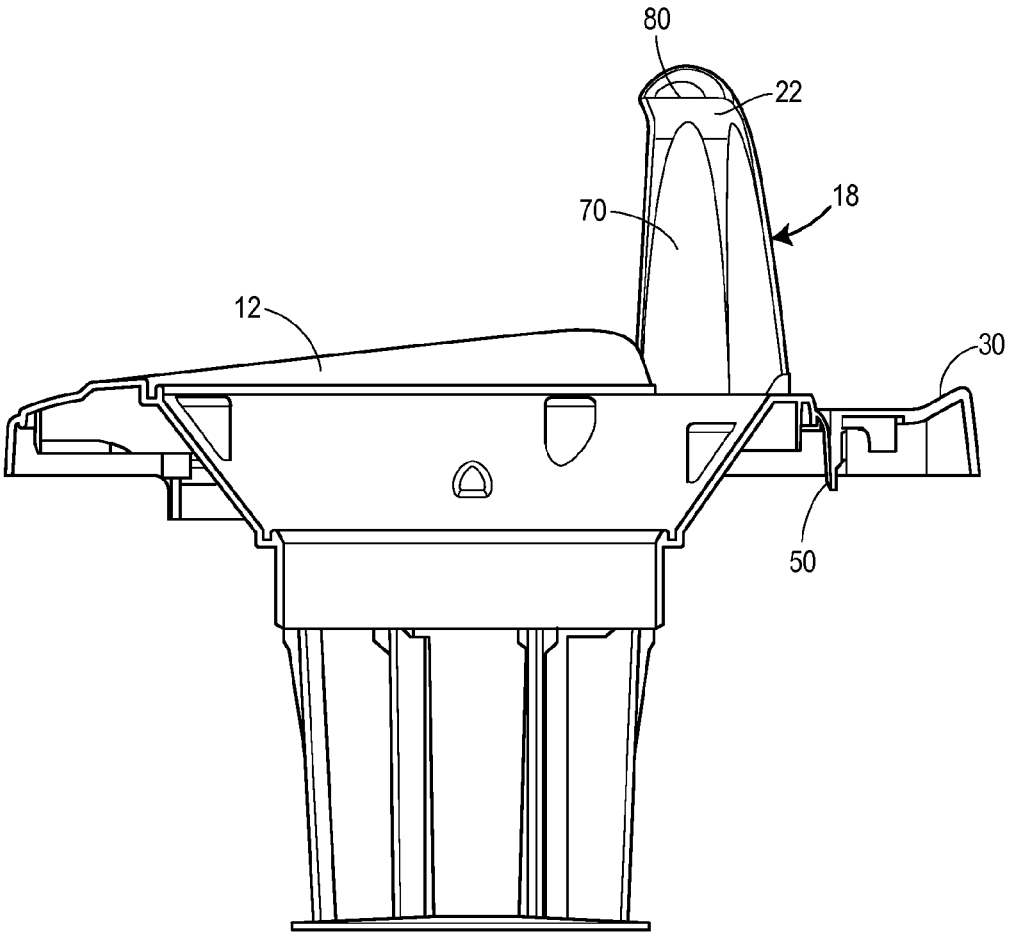
FIG. 13 is a cross section view of the rack mounted to a portion of the lid.

The rack 18 is secured to the lid 12 of the tank by a pair of laterally disposed deflectable attachment snaps 50 that fit within slots formed by lateral mounting arms 52 (best seen in FIG. 12) that extend from the outer rim 32 on the lid. The illustrated mounting arms are positioned radially outwards from the rim, but they could also be radially aligned with or radially inwards from the rim. The engagement of the snaps in the slots (FIG. 13) prevents the rack from being lifted off the main body 20 of the vacuum cleaner. Other arrangements could be used, including arrangements in which the attachment snaps are part of the lid and the slots are formed on the rack. The illustrated snaps are aligned with the circumference of the vacuum cleaner, helping to maintain a compact size. Providing laterally-spaced snaps may help to limit rotation and provide a secure connection.

The Fence Elements

The rack 18 has two laterally-spaced fence elements 22 that are arranged to help to hold the hose 14 against the main body 20 of the vacuum cleaner in a stored arrangement. Each of the illustrated fence elements has a base 60 that is connected to the frame section 30 by arms 62 that space the base outwardly away from a corresponding element of the main body of the vacuum cleaner. The illustrated fence elements are spaced between 1 and 6 inches laterally outwards from the rim 32. Generally, the spacing should at least equal the outside diameter of the hose 14, though a tighter spacing could be used to pinch the hose in place.

Figure 5:
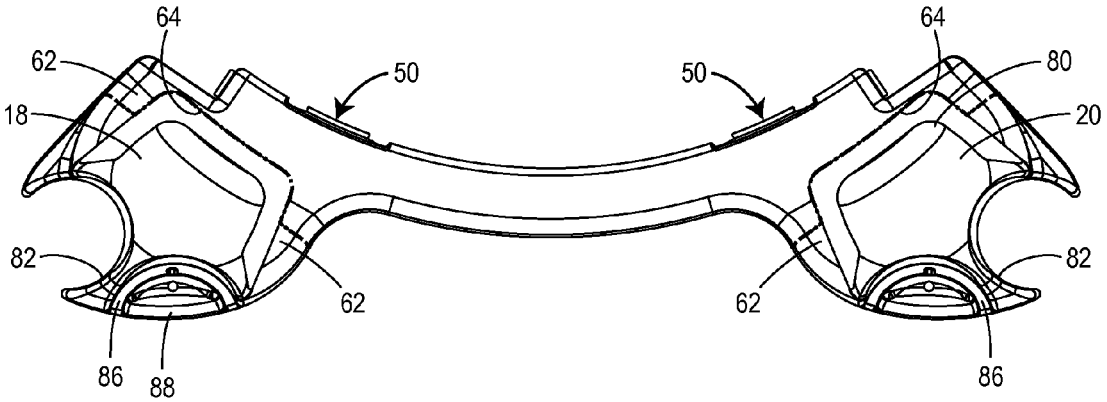
FIG. 5 is a top plan view of the rack.
Figure 6:
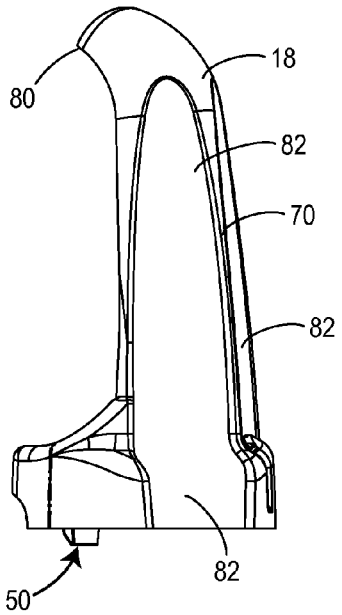
FIG. 6 is a left side view of the rack.
Figure 7:
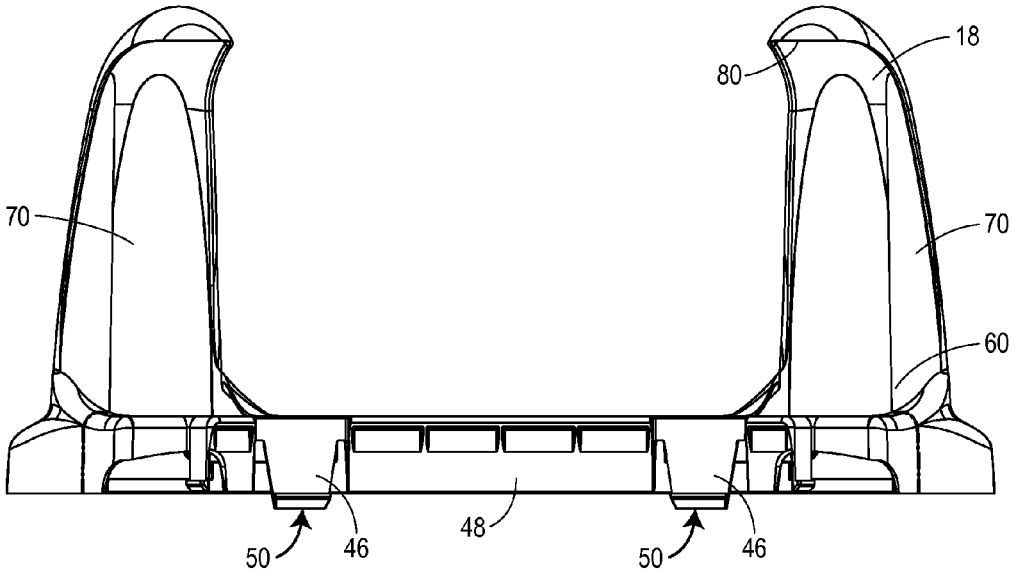
FIG. 7 is a front view of the rack.
Figure 8:
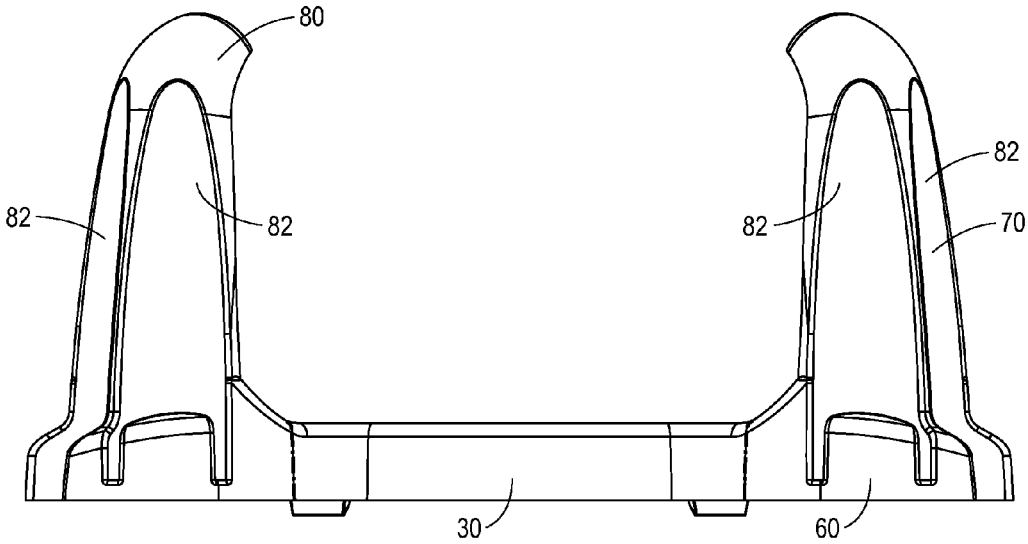
FIG. 8 is a back view.
Figure 9:
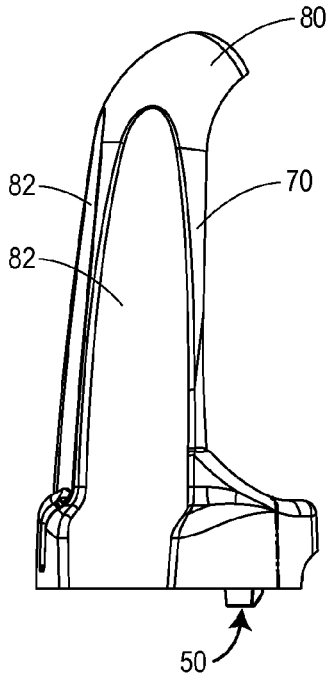
FIG. 9 is a right side view of the rack.
Figure 10:
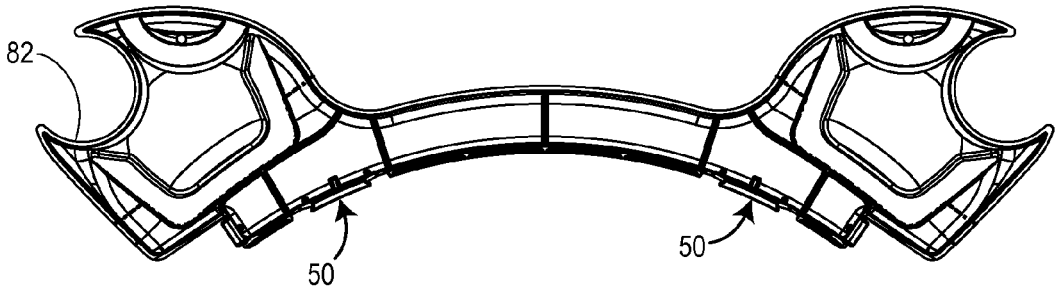
FIG. 10 is a bottom plan view.

The illustrated arms 62 extend generally vertically, from opposite lateral sides of the fence element 22, and are separated by a central opening 64. As seen in FIG. 5, the illustrated central opening is laterally wider than corresponding portions of the associated fence element 20. This arrangement may facilitate molding of the fence element. Alternatively, a single or solid arm might be used to secure each fence element.

An intermediate section 70 rises generally vertically from each base 60. The fence elements are positioned so that the hose can be stored laterally between the intermediate section and the main body 20 of the vacuum cleaner, as seen in FIG. 1.

The illustrated fence elements 22 each have an inwardly hooked upper end 80. The hooked upper end is spaced at more than ½ of one hose diameter above the arms 62, and serves to help retain the hose 14 between the main body 20 of the vacuum cleaner and the intermediate section 70 of the fence elements 22 when the hose is stored there.

The outer surface of the intermediate section 70 of each hose fence element 22 has a pair of laterally adjacent concave outer surfaces 82 that form parts of two separate tool storage elements 24. Hose accessory retainers are provided at the lower ends of the concave outer surfaces. One of the retainers has opposed clip ends 84 that form a clip that can hold in place a vacuum hose accessory 86 (see FIGS. 1 and 2). The illustrated clip ends are arranged vertically, are between ¼ and 2 inches in height, and are spaced apart by a distance of less than twice the radius of the concave outer surface. The illustrated clip ends are integrally formed with the base 60, enabling efficient manufacture. As seen in FIG. 1, the clip ends hold the vacuum accessory against the concave outer surface of the tool storage element.

The special integration of the tool storage elements 24 into the hose fence element 22 provides an efficient, compact design. With this design, the radial distance between the wrapped hose and stored accessories can be less than F. In the illustrated example, it is less than ½".

Figure 4:
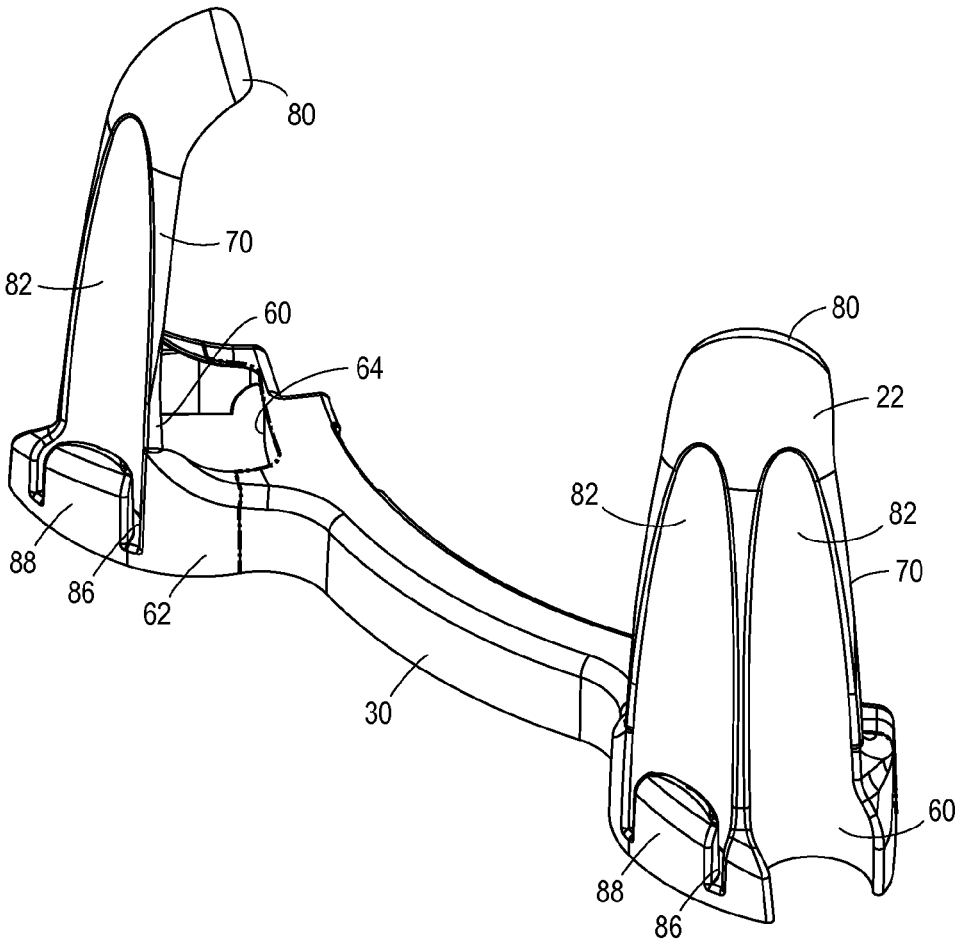

The other hose accessory retainer, best seen in FIGS. 4 and 5, has a lower bottom end 86 that extends radially outwards to an upwardly projecting stem section 88. The stem section is sized to fit within an interior portion of a vacuum hose accessory 90 (FIG. 1) and inhibit that vacuum hose accessory from moving outwardly when the accessory that is mounted in that hose accessory retainer. The illustrated stem section has an outer periphery with a curvature that is concentric with the curvature of the associated concave outer surface. The illustrated stem section is no more than 1" tall. Taller stems sections could be used, but in some cases it may be impractical to do so.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner that comprises:

a main body comprises a tank and a removable lid that mounts to the tank;

a hose that connects to the main body;

a rack that connects to the main body;

hose fence elements that are on the rack and are arranged to help hold the hose against the main body in a stored arrangement; and tool storage elements that are on an outer surface of the rack and are formed to hold vacuum hose accessories.

2. A vacuum cleaner as recited in claim 1, in which:

the vacuum cleaner has a vacuum source in the lid and all ducting is in the lid.

3. A vacuum cleaner as recited in claim 1, in which:

the rack has wall segments that that fit against a peripheral wall on the main body; and the rack is held in place on the main body by an engagement of deflectable attachments snaps against lateral mounting arms.

4. A vacuum cleaner as recited in claim 1, in which:

at least one of the tool storage elements comprises a concave surface with a lower opposed ends that form a clip that is configured to hold in place a vacuum hose accessory.

5. A vacuum cleaner as recited in claim 1, in which:

at least one of the hose fence elements has a base that is spaced outwardly away from a corresponding element of the main body of the vacuum cleaner, an intermediate section that rises generally vertically from the base and is positioned so that the hose can be positioned laterally between the intermediate section and the main body, and an inwardly hooked upper end that helps to retain the hose between the main body and the intermediate section when the hose is stored there.

6. A vacuum cleaner as recited in claim 5, in which:

the outer surface of the intermediate section of the hose fence element has a pair of laterally adjacent concave outer surfaces that form parts of two separate tool storage elements.

7. A vacuum cleaner as recited in claim 6, in which lower ends of each of the two adjacent concave outer surfaces are provided with hose accessory retainers that take the form of one of the following:

opposed ends that form a clip that is configured to hold in place a vacuum hose accessory; and a lower lateral end that extends radially outwardly to an upwardly projecting stem section that is sized to fit within an interior portion of a vacuum hose accessory and inhibit that vacuum hose accessory from moving outwardly when that vacuum hose accessory is mounted in that hose accessory retainer.

8. A vacuum cleaner that comprises:

a main body that comprises a tank and a lid that mounts to the tank;

a hose that connects to the main body;

a removable rack that connects to the main body;

deflectable attachment snaps that engage lateral mounting arms to secure the rack to the main body of the vacuum cleaner;

one or more tool storage elements that are on the rack and have a concave outer surface with a lower opposed ends that form a clip that is configured to hold in place a vacuum hose accessory; and at least two laterally-spaced fence elements that are on the rack and are arranged to help to hold the hose against the main body of the vacuum cleaner in a stored arrangement.

9. A vacuum cleaner that comprises:

a main body that comprises a tank and a lid that removably mounts to the tank;

a hose that connects to the main body;

a removable rack that connects to the main body;

one or more wall segments that are on the rack, fit against a peripheral wall on the main body of the vacuum cleaner, and help hold the rack in position on the main body of the vacuum cleaner;

deflectable attachment snaps that engage lateral mounting arms to secure the rack in place on the main body of the vacuum cleaner;

at least two laterally-spaced fence elements that are on the rack and are arranged to help to hold the hose against the main body of the vacuum cleaner in a stored arrangement;

a base that is on one of the fence elements and is spaced outwardly away from a corresponding element of the main body of the vacuum cleaner;

an intermediate section that rises generally vertically from the base section, has a pair of laterally adjacent concave outer surfaces, and is positioned so that the hose can be positioned laterally between the intermediate section and the main body of the vacuum cleaner;

an inwardly hooked upper end that extends from the intermediate section and helps to retain the hose between the main body of the vacuum cleaner and the intermediate section when the hose is stored there;

hose accessory retainers that are on the rack at the bottom of each of the concave surfaces and each take the form of one of the following:

opposed ends that form a clip that is configured to hold in place a vacuum hose accessory; and a lower lateral end that extends radially outwardly to an upwardly projecting stem section that is sized to fit within an interior portion of another vacuum hose accessory and inhibit that other vacuum hose accessory from moving outwardly when that other accessory is mounted in that hose accessory retainer.

10. A vacuum cleaner as recited in claim 9, in which the radial distance between a stored hose and a stored accessory is no more than ½ inch.

* * * * *

UNITED STATES PATENT AND TRADEMARK OFFICE

CERTIFICATE OF CORRECTION

PATENT NO. : 9,167,942 B1
APPLICATION NO. : 14/445884
DATED : October 27, 2015
INVENTOR(S) : Craig A. Seasholtz et al.

It is certified that error appears in the above-identified patent and that said Letters Patent is hereby corrected as shown below:

On the Title Page:

At item (57), line 4, "help hold" should be -- help to hold --.

In the Claims:

At Column 4, line 27, "help hold" should be -- help to hold --.

At Column 5, line 28, "help hold" should be -- help to hold --.

Signed and Sealed this
Twenty-fourth Day of May, 2016

Michelle K. Lee

Michelle K. Lee
*Director of the United States Patent and Trademark Office*